US012584283B2

(12) United States Patent
Nora

(10) Patent No.: US 12,584,283 B2
(45) Date of Patent: Mar. 24, 2026

(54) GROUND COMPACTING MACHINE WITH A VIBRATION DAMPING ASSEMBLY

(71) Applicant: TMK Designs, LLC, San Diego, CA (US)

(72) Inventor: Lawrence C. Nora, San Diego, CA (US)

(73) Assignee: DR. STRONG TECHNOLOGY DEVELOPMENT LTD., Beijing (CN)

( * ) Notice: Subject to any disclaimer, the term of this patent is extended or adjusted under 35 U.S.C. 154(b) by 720 days.

(21) Appl. No.: 18/102,049

(22) Filed: Jan. 26, 2023

(65) Prior Publication Data

US 2024/0254712 A1 Aug. 1, 2024

(51) Int. Cl.
*E02D 3/046* (2006.01)
*E01C 19/40* (2006.01)

(52) U.S. Cl.
CPC ..... *E02D 3/046* (2013.01); *E01C 19/402* (2013.01)

(58) Field of Classification Search
CPC ..... E02D 3/046; E01C 19/402
USPC ..... 404/133.05, 133.1
See application file for complete search history.

(56) References Cited

U.S. PATENT DOCUMENTS

2003/0175078 A1* 9/2003 Sina ..... E02D 3/061 404/133.1
2009/0035065 A1* 2/2009 Gavins ..... E02D 3/046 404/114
2011/0091279 A1* 4/2011 Kuerten ..... E02D 3/046 404/133.1
2013/0004237 A1* 1/2013 Krings ..... E01C 19/288 404/133.05
2016/0032548 A1* 2/2016 Braun ..... E02D 3/068 404/133.1
2020/0332481 A1* 10/2020 Hartmann ..... E01C 19/38
2022/0049507 A1* 2/2022 Reiter ..... E01C 19/402

OTHER PUBLICATIONS

Tomahawk, 2.4 HP Battery Powered Vibratory Rammer Tamper Compactor with Honda GXE2.0S Motor, Tomahawk Power, https://tomahawk-power.com/collections/vibratory-rammers/products/2-4hp-battery-powered-vibratory-rammer-tamper-compactor-honda-gxe2-0s-motor, retrieved on Jan. 24, 2023.

* cited by examiner

*Primary Examiner* — Raymond W Addie
(74) *Attorney, Agent, or Firm* — Dickinson Wright PLLC

(57) ABSTRACT

A ground compacting machine including a tamping assembly that includes a tamping foot configured to oscillate in a vertical direction for compacting soil. A drive assembly includes a motor connected to the tamping assembly for driving the oscillating movement of the tamping foot. A control assembly includes a controller for controlling operation of the drive assembly. A vibration damping assembly is located between the control assembly and the tamping assembly for damping vibrations to the control assembly from the tamping foot during movement of the tamping foot. The vibration damping assembly includes at least one vertical damper oriented generally in the vertical direction for damping vibrations in the vertical direction, and at least one horizontal damper oriented generally in a horizontal direction being perpendicular to the vertical direction for damping vibrations in the horizontal direction.

18 Claims, 3 Drawing Sheets

GROUND COMPACTING MACHINE WITH A VIBRATION DAMPING ASSEMBLY

TECHNICAL FIELD

The present disclosure relates to ground compacting machines. More particularly, the present disclosure is directed to a ground compacting machine with a vibration damping assembly that permits the ground compacting machine to operate with a large compaction force and at high frequencies without damaging a controller and associated components.

BACKGROUND

Ground compacting machines are known in the construction industry for eliminating sub-surface voids to reduce hazards associated with positioning heavy objects, like construction equipment on the ground. Ground compacting machines typically include a flat tamping foot of a hard material such as steel that is configured to oscillate in a vertical direction against the ground at a high frequency and at a high compaction force to compress the ground and fill in sub-surface voids. Ground compacting machines typically include a handle assembly for allowing an operator to control the ground compacting machine and a controller for allowing an operator to electronically adjust settings of the ground compacting machine. As technology advances and ground compacting machines become more powerful, an issue is that controllers can be damaged due to their inability to withstand high force and frequency vibrations.

SUMMARY OF THE INVENTION

According to an aspect of the present disclosure, a ground compacting machine is provided that prevents damage to a controller by damping vibrations prior to reaching the controller.

According to another aspect of the disclosure, a ground compacting machine is provided that is well-balanced during use, thus providing long term life to components and providing an easy to operate and ergonomic machine.

According to these and other aspects of the present disclosure, a ground compacting machine includes a tamping assembly that includes a tamping foot configured to oscillate in a vertical direction for compacting soil. A drive assembly includes a motor connected to the tamping assembly for driving the oscillating movement of the tamping foot. A control assembly includes a controller for controlling operation of the drive assembly. A vibration damping assembly is located between the control assembly and the tamping assembly for damping vibrations to the control assembly from the tamping foot during movement of the tamping foot. The vibration damping assembly includes at least one vertical damper oriented generally in the vertical direction for damping vibrations in the vertical direction, and at least one horizontal damper oriented generally in a horizontal direction that is perpendicular to the vertical direction for damping vibrations in the horizontal direction.

The arrangement of dampers arranged both horizontally and vertically provides a well-balanced arrangement of vibration dampers that minimizes vibrations transmitted to the control assembly. Furthermore, the use of both horizontally and vertically arranged dampers allows a desired damping effect to be optimized by locating the horizontal and vertical dampers at specific locations.

According to the above and other aspects of the disclosure, a ground compacting machine includes a tamping assembly including a tamping foot configured to oscillate in a vertical direction for compacting soil. A drive assembly includes a motor connected to the tamping assembly for driving the tamping foot. A lower frame is connected to the drive assembly and an upper frame connected to the lower frame. A control assembly is supported by the upper frame and including a controller for controlling operation of the drive assembly. A vibration damping assembly includes at least one damper between the drive assembly and the lower frame for damping vibrations between the drive assembly and the lower frame during oscillation of the tamping foot, and at least one damper between the lower frame and the upper frame for damping vibrations between the lower frame and the upper frame during oscillation of the tamping foot.

The arrangement of dampers arranged between both the drive assembly and lower frame, and between the lower and upper frames further provides a well-balanced arrangement of vibration dampers that minimize vibrations transmitted to the control assembly. Additionally, the arrangement of dampers at two different locations allows a desired damping effect to be optimized.

BRIEF DESCRIPTION OF THE DRAWINGS

Other aspects of the present disclosure will be readily appreciated, as the same becomes better understood by reference to the following detailed description when considered in connection with the accompanying drawings wherein.

DETAILED DESCRIPTION OF THE EXEMPLARY EMBODIMENTS

Figure 1:
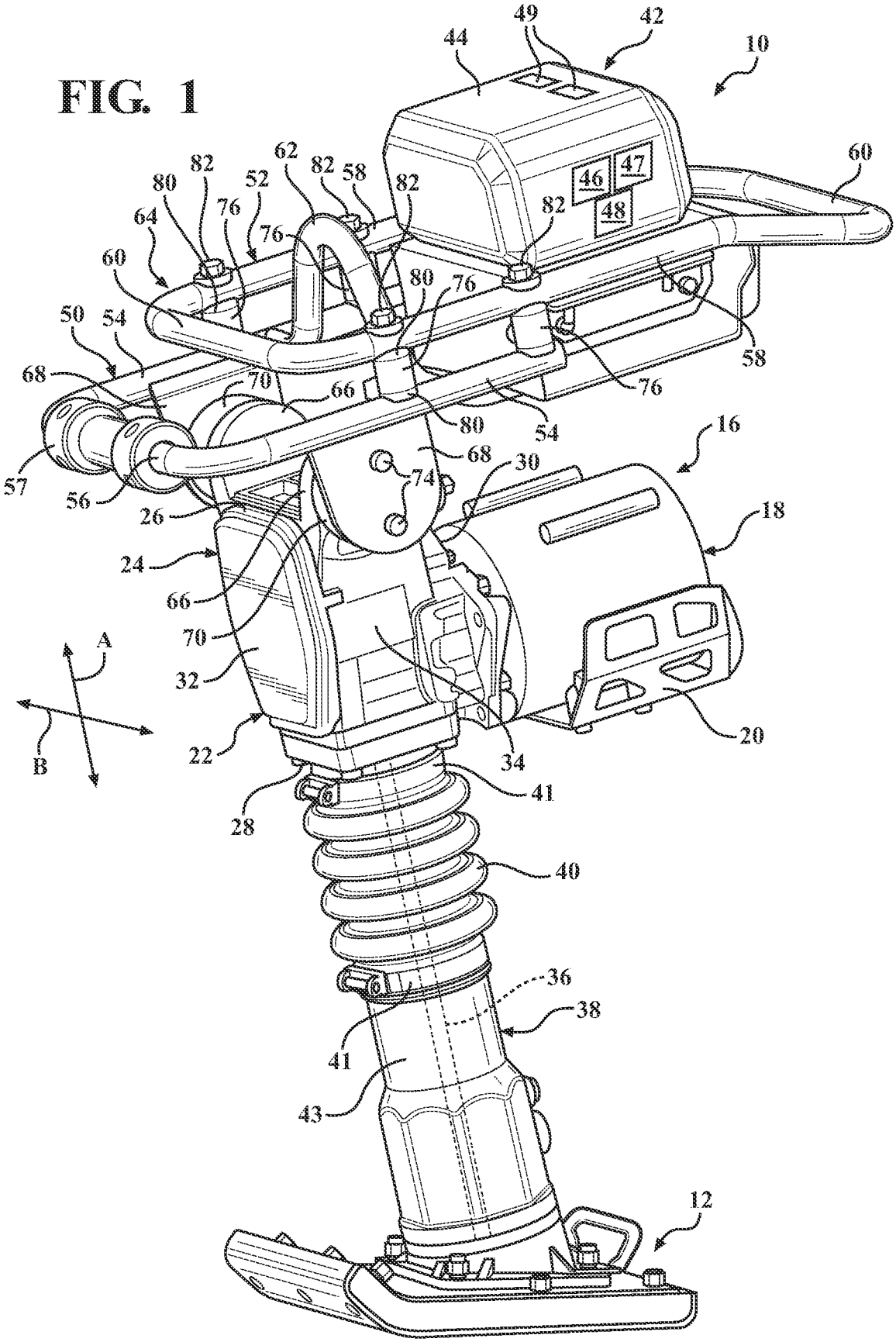
FIG. 1 is a perspective, left side view of a ground compacting assembly according to an aspect of the disclosure.
Figure 2:
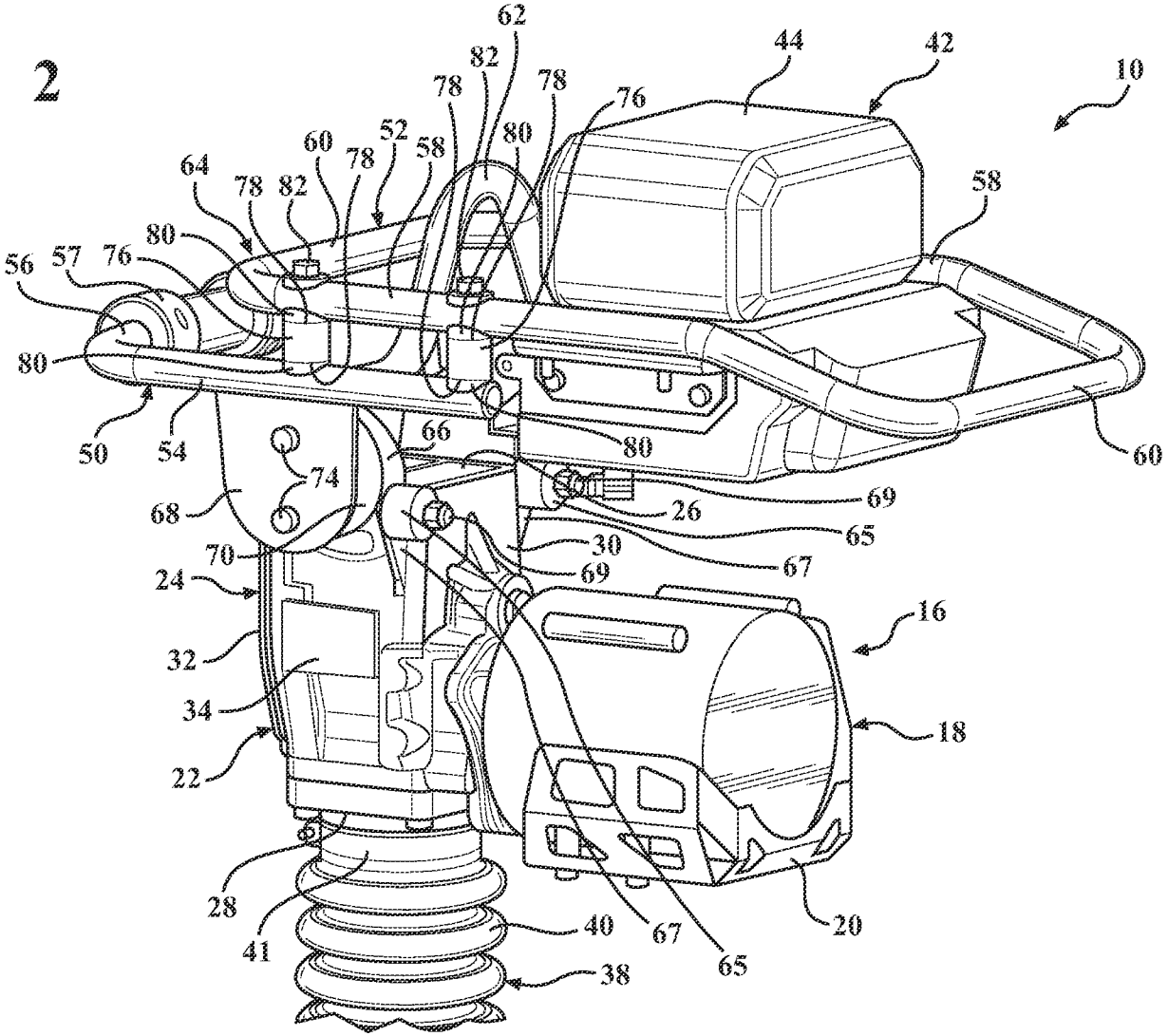
FIG. 2 is a perspective, magnified left side view of the ground compacting assembly according to an aspect of the disclosure.

In the following description, details are set forth to provide an understanding of the present disclosure. In some instances, certain systems, structures and techniques have not been described or shown in detail in order not to obscure the disclosure.

Referring to the figures, wherein like numerals indicate corresponding parts throughout the several views, an example embodiment of a ground compacting machine 10 is shown. The ground compacting machine 10 is used to apply a downward pressure to the ground to compress the ground and fill in sub-surface voids, such as for use in the construction industry to reduce safety hazards associated with introducing heavy equipment on top of the ground. The ground compacting machine 10 may be used to compress various types of materials on the ground such as dirt, soil and gravel.

The ground compacting machine 10 includes a tamping assembly 12 that includes a tamping foot 14 for oscillating in a vertical direction to compact the ground. The tamping assembly 14 also includes connecting components for connecting the tamping foot 14 to a drive assembly 16. The tamping foot 14 is made of a hard material such as steel, and can have various shapes and sizes, but should include a generally planar region with a large surface area for contacting the ground.

The drive assembly 16 is configured to drive the tamping foot 14 in an oscillating motion in vertical directions (illustrated by arrow A in FIG. 1). It should be appreciated that the terms "vertical" and "horizontal" as used herein generally refer to vertical and horizontal directions relative to the ground during use, and "vertical" may include minor angular deviations from being perpendicular to the ground, and "horizontal" may include minor angular deviations from being parallel to the ground. Additionally, "horizontal" may include any direction along a horizontal plane that is perpendicular to the vertical direction. The drive assembly 16 includes a motor 18 that has an output (not shown). According to the example embodiment, the motor 18 is an electric motor, but other types of motors could be used, like an internal combustion engine. A protective cage 20 partially surrounds the motor 18 for preventing damage to the motor 18.

The drive assembly 16 further includes a transmission 22 that is connected to the output of the motor 18 for adjusting a gear ratio of the output of the motor 18. The transmission 22 is contained in a drive housing 24. The drive housing 24 has a top surface 26, a bottom surface 28 opposite the top surface 26, a front surface 30, a rear surface 32 and a pair of side surfaces 34.

The drive assembly 16 also includes a load transmitting device 36 (schematically shown in FIG. 1) that is partially located in the drive housing 24, and which interconnects an output of the transmission and the tamping foot 14 for converting a rotational drive force of the output of the motor 18/transmission 22 into a linear vibrational/oscillating movement of the tamping foot 14 in the vertical direction. According to the example embodiment, the load transmitting device 36 is a connecting rod, but other styles of load devices could be used without departing from the scope of the subject disclosure.

A conduit 38 surrounds the load transmitting device 36 between the bottom surface 28 of the drive housing 24 and the tamping foot 14 for sealing a region around the load transmitting device 36 to prevent the load transmitting device 36 from being damaged or contaminated. The conduit 38 includes a bellowed region 40 for permitting linear expansion and contraction of the conduit 38 for facilitating movement of the load transmitting device 36 while maintaining a seal around the load transmitting device 36. The bellowed region 40 is secured to a tube portion 43 of the conduit via clamps 41 or other suitable fastening devices.

A control assembly 42 controls operation of, and powers the drive assembly 16. The control assembly 42 includes a control housing 44 that contains a controller 46 and associated power distribution unit (PDU) 47 (both schematically shown in FIG. 1) which are electrically connected to the motor 18 for controlling an output of the motor 18. The control assembly 42 also includes a battery 48 (schematically shown in FIG. 1) that is further located in the control housing 44, and which is electrically connected to the controller 46, PDU 47 and the motor 18 for powering all electrical components of the ground compacting machine 10. A series of controls 49 (schematically shown in FIG. 1) such as buttons, knobs, etc. may be located on the control housing 44 or any other location of the ground compacting machine 10 for allowing a user to adjust operation of the ground compacting machine 10, e.g., force and frequency settings.

A lower frame 50 is coupled to the drive housing 24, and an upper frame 52 is coupled to the lower frame 50 and supports the control housing 44. The lower frame 50 generally has a U-shape, and is comprised of a pair of lower legs 54 that extend in parallel relationship with one another, and a lower crossbar 56 that extends between the pair of lower legs 54.

The upper frame 58 generally has an oval shape and has a pair of upper legs 58 that extend in parallel relationship with one another, and a pair of upper crossbars 60 that extend in spaced and parallel relationship with one another between the upper legs 58. A handle 62 extends in an arc-shape between the pair of lower legs 54 of the lower frame 50 for assisting an operator in controlling the ground compacting machine 10. It should also be appreciated that other portions of the upper and lower frames 50, 52 may serve as handles.

Furthermore, a roller 57 may be positioned around the lower crossbar 56 to assist an operator in rolling the machine 10 into a storage or transport mechanism like a bed of a pickup truck or a trailer. Similar rollers or other loading features could be locate at other regions of the machine.

Figure 3:
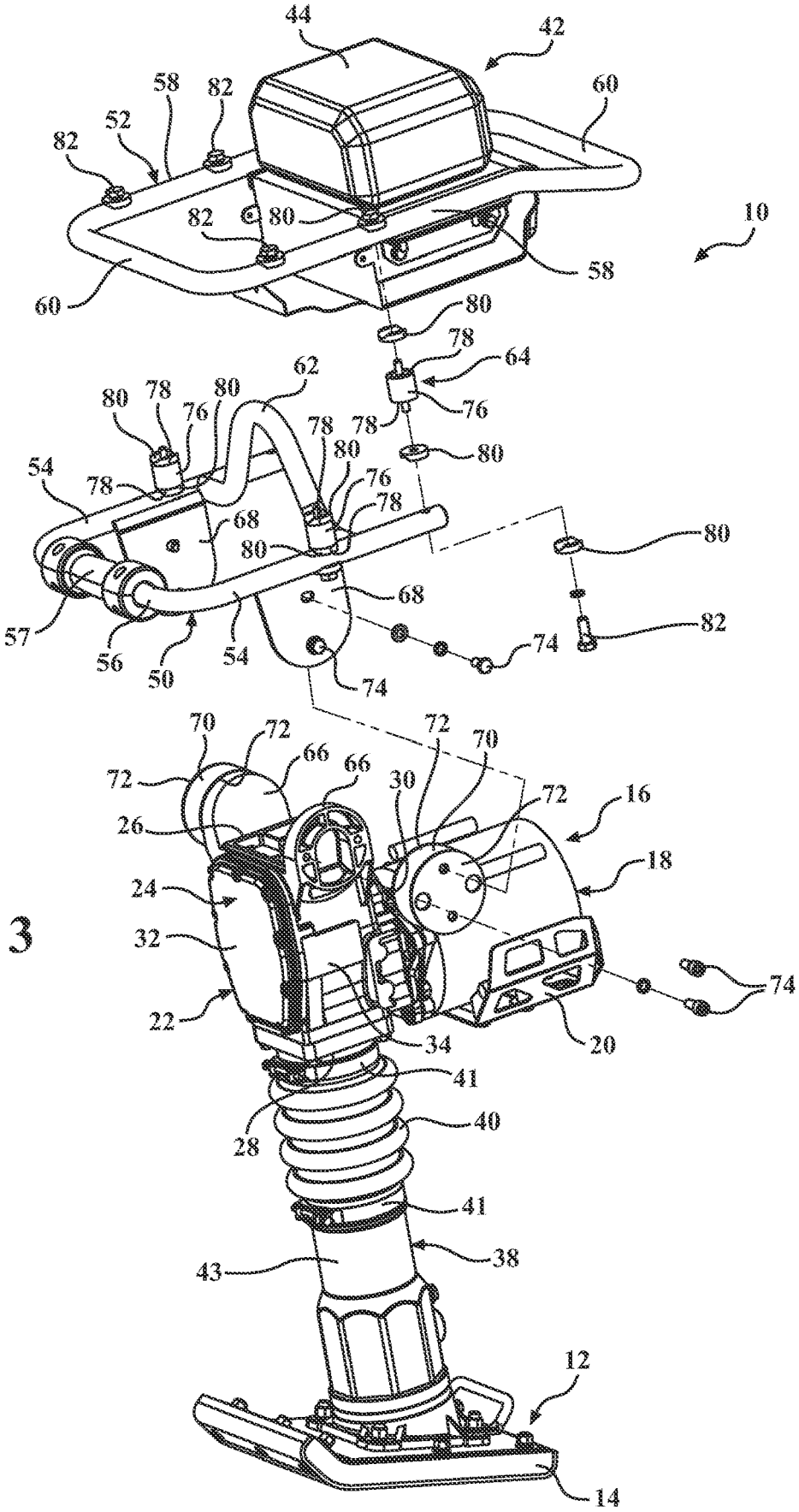
FIG. 3 is a perspective, left side exploded view of the ground compacting assembly, illustrating an arrangement of horizontal and vertical dampers according to an aspect of the disclosure.

A vibration damping assembly 64 is located between the control assembly 42 and the tamping assembly 12 for damping vibrations to the control assembly 42 during the oscillating movement of the tamping foot 14. As best shown in FIG. 3, the vibration damping assembly 64 may include a pair of lower securement flanges 66 that extend upwardly from the side surfaces 34 of the drive housing 24 in spaced and parallel relationship with one another. A pair of upper securement flanges 68 extend downwardly from the lower legs 54 of the lower frame 50, each in alignment with one of the lower securement flanges 66. A pair of first horizontal dampers 70 of a flexible material like rubber are each located between one of the lower and upper securement flanges 66, 68 for damping vibrations between the drive housing 24 and the lower frame 50 in a first horizontal direction (an exemplary horizontal direction is labeled as arrow B in FIG. 1). Each of the first horizontal dampers 70 generally has a cylindrical shape and extends in the first horizontal direction B between a pair of end faces 72. The vibration damping assembly 64 further includes a plurality of horizontal fasteners 74, with a pair of the horizontal fasteners 74 extending through each of the adjacent lower and upper securement flanges 66, 68 and first horizontal dampers 74 for connecting the upper and lower securement flanges 66, 68 and first horizontal dampers 74 to one another. Various types of fasteners may be employed for the first horizontal fasteners 74, including, but not limited to bolts.

The vibration damping assembly 64 may further include a pair of side flanges 67 that extend upwardly from the side surfaces 34 of the drive housing 24 in spaced and parallel relationship with one another. A pair of second horizontal dampers 65 of a flexible material such as rubber are each connected to one of the side flanges 67. As shown, the side dampers 65 have a cylindrical shape and extend in a horizontal direction that is perpendicular to the horizontal direction of the horizontal dampers 74. A pair of side fasteners 69 connect the second horizontal dampers 65 to the side flanges 67. Again, various types of fasteners may be employed for the vertical fasteners 82, including, but not limited to bolts. The second horizontal dampers 65 dampen vibrations between the drive housing 24 and the lower frame 50 along the horizontal plane in a direction perpendicular to the direction of the first horizontal dampers 74, which notably helps to stabilize the larger first horizontal dampers 74.

The vibration damping assembly 64 may further includes four vertical dampers 76 of a flexible material such as rubber for damping vibrations between the lower and upper frames 50, 52. Two of the vertical dampers 76 are located between each of the lower and upper legs 54, 58 of the lower and upper frames 50, 52. Each of the vertical dampers 76 generally has a cylindrical shape and extends substantially in the vertical direction between a pair of end faces 78. The vibration damping assembly 64 also includes a plurality of washers 80, with a pair of washers 80 located on opposing sides of each of the four vertical dampers 76 at the end faces 78. A plurality of vertical fasteners 82 each extend through the lower and upper legs 54, 58, a pair of the washers 80 and one of the vertical dampers 76. Again, various types of fasteners may be employed for the vertical fasteners 82, including, but not limited to bolts. According to an aspect of the disclosure, the vertical dampers 76 have a higher density and hardness than the horizontal dampers 70.

According to the aforementioned positional arrangement of vertical and horizontal dampers 76, 70, 65 and densities, it has been found that the horizontal dampers 70, 65 absorb a majority of the initial impact of the machine 10, while the vertical dampers 76 absorb most of the remaining vibrations to the upper frame 52. Additionally, the arrangement provides a well-balanced machine during use. This provides long lasting component life, ergonomic use for the operator, and more controllability for the operator. This is particularly significant since the machine 10 is relatively top-heavy due to the location of the motor 18 and transmission 22. The arrangement of the example embodiment was tested and found to deliver approximately 10 g (98 $M/S^2$) to the control housing 44 while prior ground compacting machines 10 were found to deliver over 40 g (400 $M/S^2$) to a controller, thus evidencing a drastic vibration reduction to the controller 46.

In summary, the arrangement of the subject ground compacting machine 10 minimize vibrations to the controller 46 and PDU 47 which are positioned at a location near a top of the machine 10, thus reducing a risk of these components being damaged during use.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. Although embodiments of the present invention are described above, the present invention is not limited to the above embodiment. Furthermore, aspects of the embodiments may be mixed with one another.

What is claimed is:

1. A ground compacting machine, comprising:

a tamping assembly including a tamping foot configured to oscillate in a vertical direction for compacting soil;

a drive assembly including a motor connected to the tamping assembly for driving the oscillating movement of the tamping foot;

a control assembly including a controller for controlling operation of the drive assembly;

a lower frame connected to the tamping assembly;

an upper frame connected to the lower frame and supporting the control assembly; and a vibration damping assembly between the control assembly and the tamping assembly for damping vibrations to the control assembly from the tamping foot during movement of the tamping foot, the vibration damping assembly including at least one vertical damper oriented generally in the vertical direction for damping vibrations in the vertical direction and at least one horizontal damper oriented generally in a horizontal direction being perpendicular to the vertical direction for damping vibrations in the horizontal direction, wherein the at least one vertical damper is located between the lower and upper frames for damping vibrations between the lower and upper frames.

2. The ground compacting machine as set forth in claim 1, wherein the at least one horizontal damper has a higher density and hardness than the at least one vertical damper.

3. The ground compacting machine as set forth in claim 1, wherein the at least one vertical damper located between the upper and lower frames includes a plurality of vertical dampers.

4. The ground compacting machine as set forth in claim 3, wherein the lower frame includes a pair of lower legs extending in spaced and parallel relationship with one another and a lower crossbar extending between the pair of lower legs, wherein the upper frame includes a pair of upper legs extending in spaced and parallel relationship with one another and at least one upper crossbar extending between the upper legs, and wherein two of the vertical dampers extend between one of the upper legs and one of the lower legs, and wherein another two of the vertical dampers extend between another of the upper legs and another of the lower legs.

5. The ground compacting machine as set forth in claim 4, wherein a washer is located on each side of each of the vertical dampers, and wherein a fastener extends through each of the vertical dampers and the washers and through the upper and lower legs in order to secure the vertical dampers and washers to the upper and lower legs.

6. The ground compacting machine as set forth in claim 4, wherein a handle extends between the pair of lower legs of the lower frame for assisting an operator in operating the ground compacting machine.

7. The ground compacting machine as set forth in claim 3, wherein the vertical dampers each have a cylindrical shape extending between a top surface and a bottom surface in the vertical direction.

8. The ground compacting machine as set forth in claim 1, wherein at least one of the dampers is located between the tamping assembly and the lower frame for damping vibrations between the tamping assembly and the lower frame.

9. The ground compacting machine as set forth in claim 8, wherein the at least one damper located between the tamping assembly and the lower frame includes the at least one horizontal damper.

10. The ground compacting machine as set forth in claim 9, wherein the at least one horizontal damper has a cylindrical shape and extends between first and second surfaces in the horizontal direction.

11. The ground compacting machine as set forth in claim 1, wherein the tamping assembly includes a drive housing containing a transmission, wherein a pair of lower securement flanges extend upwardly from the drive housing in spaced and parallel relationship with one another, wherein a pair of upper securement flanges extend downwardly from the lower frame in spaced and parallel relationship with one another, wherein one of the upper securement flanges and one of the lower securement flanges are aligned with one another, and another of the upper securement flanges and the lower securement flanges are aligned with one another, and wherein the at least one horizontal damper includes a pair of horizontal dampers each located between one of the aligned upper and lower securement flanges.

12. The ground compacting machine as set forth in claim 11, wherein a washer is located on each side of each of the horizontal dampers, and wherein a fastener extends through each of the horizontal dampers and the washers and through one of the upper and lower securement flanges in order to secure the horizontal dampers and washers to the upper and lower securement flanges.

13. The ground compacting machine as set forth in claim 1, wherein the motor is an electric motor.

14. The ground compacting machine as set forth in claim 13, wherein the control assembly further includes a battery electrically connected to the electric motor for powering the electric motor.

15. A ground compacting machine, comprising:

a tamping assembly including a tamping foot configured to oscillate in a vertical direction for compacting soil;

a drive assembly including a motor connected to the tamping assembly for driving the tamping foot;

a lower frame connected to the drive assembly and an upper frame connected to the lower frame;

a control assembly supported by the upper frame and including a controller for controlling operation of the drive assembly; and a vibration damping assembly including at least one damper between the drive assembly and the lower frame for damping vibrations between the drive assembly and the lower frame during oscillation of the tamping foot, and at least one damper between the lower frame and the upper frame for damping vibrations between the lower frame and the upper frame during oscillation of the tamping foot.

16. The ground compacting machine as set forth in claim 15, wherein the at least one damper between the drive assembly and the lower frame includes a pair of horizontal dampers each extending in a horizontal direction for damping vibrations in the horizontal direction.

17. The ground compacting machine as set forth in claim 15, wherein the at least one damper between the lower frame and the upper frame includes a plurality of vertical dampers extending in a vertical direction for damping vibrations in the vertical direction.

18. The ground compacting machine as set forth in claim 15, wherein the lower frame includes a pair of lower legs extending in spaced and parallel relationship with one another and a lower crossbar extending between the pair of lower legs, wherein the upper frame includes a pair of upper legs extending in spaced and parallel relationship with one another and at least one upper crossbar extending between the upper legs, and wherein the at least one damper extending between the upper and lower frames extends between one of the upper legs and one of the lower legs.

* * * * *